United States Patent [19]

Sumpter

[11] 4,083,153

[45] Apr. 11, 1978

[54] CEILING AND WALL STRUCTURES HAVING CURVED PANELS

[76] Inventor: Gary T. Sumpter, 402 N. Madison, Spring Hill, Kans. 66083

[21] Appl. No.: 792,057

[22] Filed: Apr. 28, 1977

[51] Int. Cl.[2] ..... E04B 1/00; E04B 2/74

[52] U.S. Cl. ..... 52/28; 52/22; 52/222; 52/238; 52/481; 52/508; 52/495

[58] Field of Search ..... 52/38, 18, 288, 222, 52/28, 22, 481, 508, 495, 238

[56] References Cited

U.S. PATENT DOCUMENTS

| | | | |
|---|---|---|---|
| 2,666,233 | 1/1954 | Klemm | 52/222 |
| 2,836,859 | 6/1958 | Crissy | 52/508 |
| 3,254,462 | 6/1966 | Toler | 52/222 |
| 3,321,877 | 5/1967 | Alexieff | 52/28 X |
| 3,386,220 | 6/1968 | Staats | 52/222 |
| 3,390,495 | 7/1968 | Dalby | 52/222 |
| 3,409,766 | 11/1968 | Meckler | 52/28 X |
| 3,513,608 | 5/1970 | Nagrod | 52/222 |
| 3,763,606 | 10/1973 | Rindebong | 52/222 |
| 3,925,938 | 12/1975 | Molen | 52/220 |

FOREIGN PATENT DOCUMENTS

| | | | |
|---|---|---|---|
| 170,420 | 2/1952 | Austria | 52/287 |
| 50,416 | 6/1935 | Denmark | 52/288 |

*Primary Examiner*—John E. Murtagh

*Attorney, Agent, or Firm*—Lowe, Kokjer, Kircher, Wharton & Bowman

[57] ABSTRACT

A ceiling includes arched panels supported by box type beams which are adjustable in width. The sides of the beams are provided with inclined grooves in which the edges of the panels are received. The panels are flexible and tend to unflex to a flat shape, thereby retaining their edges in the beam grooves. The ceiling beams include beam members which are spaced apart by adjustable spacer brackets. A bottom panel of each beam may be opened to gain access to the beam for interior adjustment of the brackets. Light fixtures are mounted within the beams above translucent panels incorporated in the bottom beam panels. Curved wall panels supported by wall beams may be employed in combination with the ceiling. In an alternative form of the invention, upright box type beams support curved wall panels and partitions.

17 Claims, 7 Drawing Figures

CEILING AND WALL STRUCTURES HAVING CURVED PANELS

BACKGROUND AND SUMMARY OF THE INVENTION

This invention relates to an improved ceiling construction comprising arched ceiling panels and box type beams. The invention additionally deals with a wall or partition structure which incorporates curved panels and upright box type support posts.

The aesthetic advantages obtained from the use of curved ceiling and wall panels have been recognized by past inventors, as exemplified by the U.S. patents to Nagrod U.S. Pat. No. 3,513,608 and Varlonga U.S. Pat. No. 3,149,436. For the most part, however, these structures are overly complex and costly, as well as lacking in strength. In addition existing ceilings which incorporate curved panels are difficult and time consuming to assemble, and they do not make adequate provision for accommodating light fixtures and other hardware items which are commonly mounted on ceilings. Moreover, most of these structures are designed to be used on only a temporary basis. The curved panels are mounted to the building in a manner to permit rapid disassembly, and the strength of their connection to the building suffers accordingly. Complex connection elements for mounting the panels to their supports are also common in existing structures of this type.

Another major problem in the prior art is found in the support members to which the curved panels are mounted. Typically, the support members are thin metal brackets which are lacking in strength and which are difficult to firmly mount to the building structure. Furthermore, the brackets are fixed in width so that for a room having a given size, the ceiling panels must be cut to a given width. Due to this lack of adjustability of the panel supports, the room size dictates the panel size and shape rather than permitting selection of panels which have the most attractive size and/or curvature.

Essentially the same problems exist with respect to curved wall panels, partitions, room dividers and the like. Moreover, in structures of this type, it is often desirable to employ panels which have a compound curvature and which approach their supports at a variety of angles and a variety of locations. However, because of the manner in which curved panels are received by and attached to their supports in existing walls and partitions, flexibility in the shape and orientation of the panels is not achieved.

In view of these problems in the prior art, a need remains for a strong and economical building structure which incorporates curved panels. It is the primary goal of the present invention to meet that need.

More specifically, it is an object of the invention to provide an improved ceiling having arched panels supported by box type beams which are stronger than the support members currently in use.

Another object of the invention is to provide a ceiling in which the beams are adjustable in width so that ceiling panels of a selected size and curvature may be employed in a room of any size.

Still another object of the invention is to provide a ceiling of the character described in which access to the interior regions of the beams is readily available to permit adjustment of the beam width.

A further object of the invention is to provide a ceiling of the character described which is constructed and arranged to allow lights and other fixtures to be mounted within the beams.

An additional object of the invention is to provide a ceiling of the character described wherein the panel edges fit closely within grooves in the beams, thereby retaining the panels in a curved shape while maintaining overall structural strength without the need for complicated connection elements.

Yet another object of the invention is to provide a ceiling of the character described which is suitable to serve either as an original ceiling or a false ceiling.

A still further object of the invention is to provide a ceiling of the character described which is improved over existing ceilings as to its appearance, economy, durability, and ease of construction.

It is another object of the invention to provide a wall or partition structure which includes curved panels that extend between upright, box type support posts.

Yet another object of the invention is to provide a wall or partition structure in which the support posts have grooves oriented to receive the panel edges in a manner to retain the panels in a compound curvature.

Other and further objects of the invention, together with the features of novelty appurtenant thereto, will appear in the course of the following description.

DETAILED DESCRIPTION OF THE INVENTION

In the accompanying drawings which form a part of the specification and are to be read in conjunction therewith and in which like reference numerals are used to indicate like parts in the various views.

Figure 1:
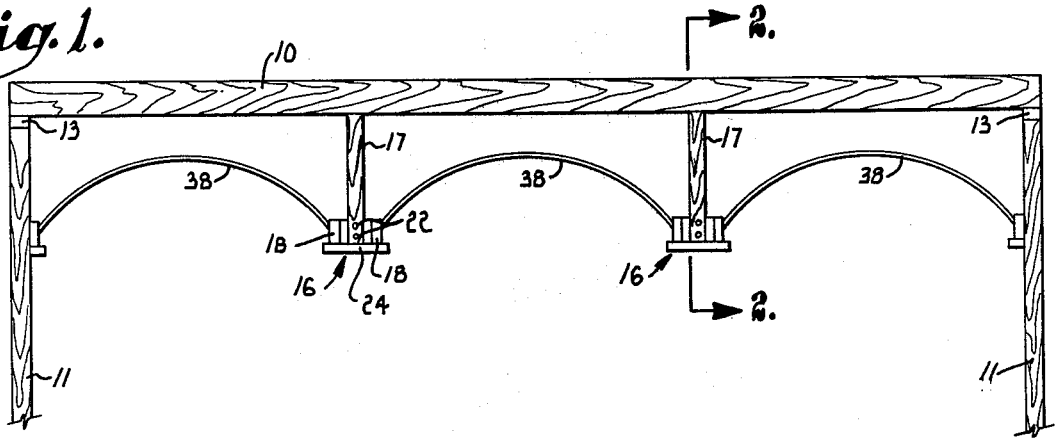
FIG. 1 is an elevational view of a ceiling constructed in accordance with a preferred embodiment of the present invention.
Figure 2:
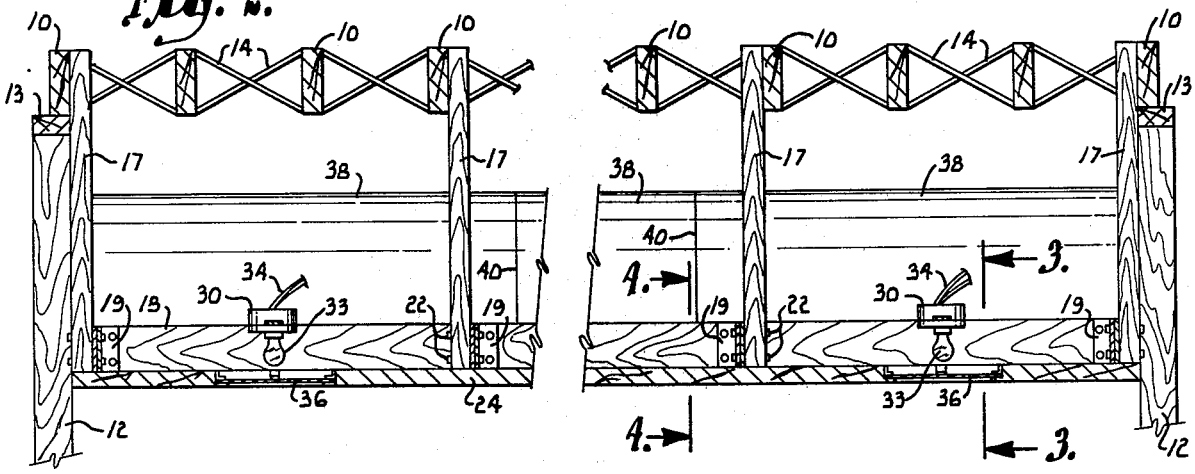
FIG. 2 is a sectional view on an enlarged scale taken generally along line 2—2 of FIG. 1 in the direction of the arrows, with the broken away portions indicating continuous length.

Referring now to the drawings in detail and initially to FIGS. 1 and 2, numeral 10 designates horizontal ceiling joists which extend between vertical side walls 11 in the usual manner. The ceiling joists 10 are parallel to one another and to the end walls 12 (FIG. 2) of the room. The ends of the joists are mounted on top of anchor boards 13 located on top of walls 11. Angled struts 14 extend between adjacent joists 10 to interconnect and reinforce them.

In accordance with the present invention, rigid elongate ceiling beams, generally designated by reference numeral 16, are mounted on the lower ends of vertical hanger members 17 which are secured at their upper ends to the ceiling joists 10. Beams 16 are generally box shaped in section, although they are open at the top. The hangers 17 mount beams 16 in horizontal extension between the opposite end walls 12 and in spaced apart, parallel relationship to one another. Hangers 17 are spaced apart from one another at selected locations, with the outermost hangers extending along the end walls 12, as shown in FIG. 2.

Figure 4:
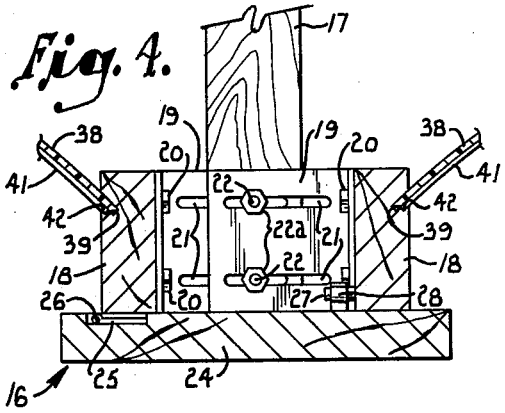
FIG. 4 is a fragmentary sectional view on an enlarged scale taken generally along line 4—4 of FIG. 2 in the direction of the arrows.

With reference now to FIG. 4 in particular, each beam 16 is open at the top and includes a pair of parallel wooden beam members 18 which are spaced apart from one another by angle brackets 19. Members 18 are horizontal, and brackets 19 are spaced selectively along their lengths. Each bracket 19 has a flange which is bolted at 20 to the inside surface of its beam member 18. Plate portions of brackets 19 extend inwardly and overlap one another, with the overlapping portions being provided with a pair of horizontal slots 21. The slots of each bracket partially coincide with those of the other bracket. Bolts 22 are fit through hanger beams 17 and through the overlapping portions of slots 21, and a nut **22*a* is threaded onto the end of each bolt and tightened to secure the brackets together. In this manner, beams 16 are mounted on the lower ends of hangers 17 and members 18** are held in spaced apart relation.

Brackets 19 are adjustable so that the spacing between beam members 18 may be varied, thereby independently varying the width of each beam 16. When nut **22*a* is loosened, the overlapping slots 21 permit the beam members 18 in each pair to be moved toward or away from one another. Subsequent tightening of nuts 22*a* secures brackets 19** to one another, thus fixing the width of the beam.

Each beam 16 has a bottom panel 24 which extends between the lower edges of beam members 18. Panel 24 thus normally covers the bottom of the interior beam compartment in which brackets 19 are located. The bottom panel may be a thin piece of hardboard or the like, or it may be a thicker wooden member. A conventional hinge 25 attaches panel 24 to one of the beams 18 in a manner permitting the panel to be swung upwardly and downwardly about the horizontal hinge pin 26. A latch for retaining panel 24 in the closed position includes a horizontal pin 27 which projects inwardly from the opposite beam member 18. The upper surface of panel 24 is provided with a pair of opposed spring type clips 28 which fit closely around pin 27 to hold the panel in the closed position shown in solid lines in FIG. 3. Panel 24 may be swung to the open position shown in broken lines in FIG. 3 by pulling downwardly on its left edge which preferably extends beyond beam member 18. This releases the latch and allows the panel to be swung downwardly in the direction of the arrow to gain access for adjustment of nuts **22*a* and brackets 19**.

Figure 3:
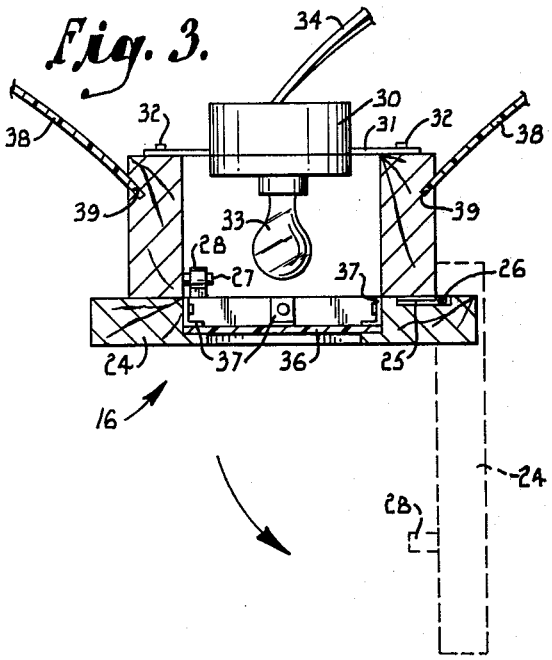
FIG. 3 is an enlarged sectional view taken generally along line 3—3 of FIG. 2 in the direction of the arrows, with the broken lines indicating movement of the bottom beam panel to an open position.

With reference now to FIG. 3 in particular, light fixtures 30 are mounted in the interior compartments of beams 16 at selected locations. The light fixtures 30 are carried on mounting plates 31 which are secured to the upper edges of beams 18 by screws 32. A bulb 33 projects downwardly from fixture 30 and is located entirely within the interior compartment of beam 16. Fixture 30 also has the electrical wiring 34.

A transparent or translucent panel 36 is mounted beneath each light bulb 33 in an otherwise open area of panel 24. Panels 36 may be retained in place by angle clips 37 secured to panel 24, or in any other suitable manner which permits them to be removed when desired.

The ceiling beams 16 provide support for arched ceiling panels 38 which extend between adjacent beams, as best shown in FIG. 1. Panels 38 are flexible members which are flat in their unflexed condition. Preferably, the panels are constructed of a material commonly known as hardboard, although they may be plexiglass, plastic, wood, or any other suitable substance. The panels 38 may be prefinished or they may be finished or painted after being assembled.

With particular reference to FIGS. 3 and 4, the outside surface of each beam member 18 is provided with an inclined groove 39 having a size to closely receive a longitudinal edge of panel 38. Grooves 39 extend the entire length of the beams and are located near the upper ends of members 18. The grooves are disposed at an inclined angle which is selected such that panels 38 will be retained in the desired arch shaped curvature. Since panels 38 are flexible members which tend to flatten out from their arched shape, the outward pressure exerted by the panels maintains their edges firmly in grooves 39, and specialized connection elements are not required. A layer of insulation (not shown) may be located on top of each panel 38.

As shown in FIG. 2, adjacent panels 38 abut one another at the ends to form a joint 40. With reference now to FIG. 4, each joint 40 is covered on the underside by a strip 41 which may be batten or another trim material. To support the strips 41, each beam member 18 is provided with small notches 42 which are located immediately below groove 39. The opposite ends of each strip 41 are closely received in the notches 42 of beam members 18, and the strips are thereby supported to extend along the underside of the panels joints 40.

Figure 5:
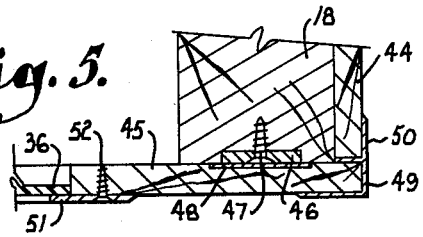
FIG. 5 is a fragmentary sectional view taken on a vertical plane and illustrating an alternative means for mounting the bottom beam panel.

FIG. 5 illustrates an alternative beam arrangement. In this embodiment, each of the wooden beam members 18 is provided on its outside surface with a thin hardboard panel 44 which may be glued or otherwise affixed to the beam. The bottom section of each ceiling beam 16 is in the form of a thin hardboard panel 45 which is secured by magnetic means to the underedges of beam members 18. A magnet 46 is mounted in a recessed location on the lower edge of beam member 18 by a screw 47. Magnets 46 are spaced along the length of members 18 at selected intervals. A ferromagnetic strip 48 for each magnet is secured to the upper surface of panel 45 near the outer edge thereof in order to attract to the magnet. A trim corner piece 49 is secured to extend along the outer edge of each panel 45, and the corner piece has an upward extension 50 which lies along the lower edge portion of panel 44 when the bottom panel 45 is in place on the beam. The entire panel 45 may be pulled downwardly to overcome the magnetic attraction and thus remove it from the beam to gain access to the beam interior. The magnets are powerful enough to maintain each panel 45 on its beam under normal circumstances.

In the embodiment of FIG. 5, the transparent or translucent panel 36 is held in place by a rectangular frame structure 51 which is screwed at 52 to panel 45. The frame 51 projects inwardly around the open area of panel 45 located beneath the light bulb. The edges of panel 36 rest on top of frame 51, so that the frame and panel 36 may be removed by loosening screws 52.

In addition to forming a "false" ceiling underlying the existing ceiling of a building, it is to be understood that the ceiling of the present invention may also form an original or main structural ceiling. In this case, the beams 16 may be mounted directly to the walls. The structural strength of the beams and curved panels is sufficient to support the loads that are normally applied to a ceiling.

Figure 6:
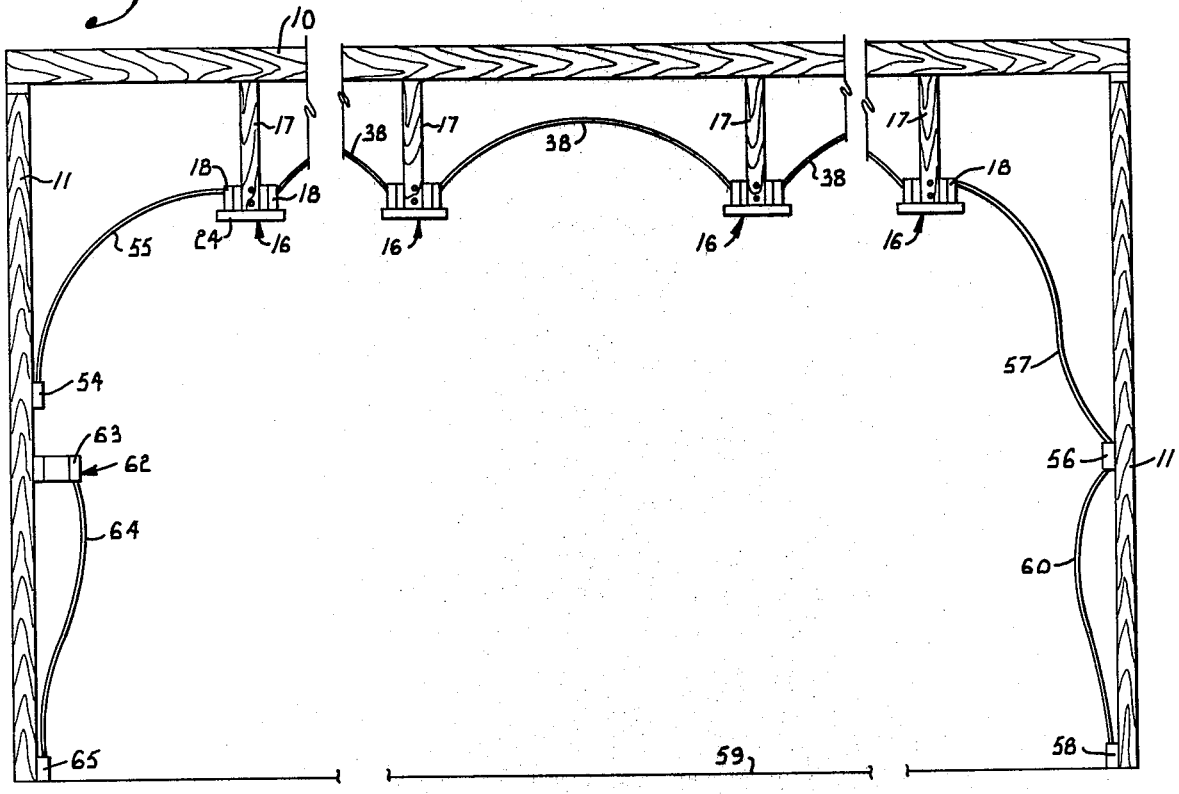
FIG. 6 is an elevational view illustrating an alternative form of the invention which additionally includes curved wall panels, with the broken away portions indicating continuous length.

FIG. 6 illustrates curved wall panels which may be employed in combination with the ceiling structure. A wooden wall beam 54 is secured to one of the side walls 11 in generally horizontal extension parallel with beams 16. A curved panel 55, which may be constructed of the same substance as panels 38, is secured to extend from beam 54 to the outside beam member 18 in the outermost ceiling beam 16. The side of beam member 18 is provided with a groove which is oriented generally horizontally. The top surface of beam 54 has a groove which is oriented generally vertically. Accordingly, the longitudinal edges of panel 55 may be received in the grooves of member 18 and beam 54 such that the panel is retained in a smoothly curved shape. Again, the tendency of the flexible panel to straighten out helps retain its edges firmly in the beam grooves.

Another horizontal wall beam 56 is secured to the opposite side wall 11 at a somewhat lower location than beam 54. The beam member 18 nearest this wall 11 is provided on its outside surface with a slightly downwardly inclined groove which receives one longitudinal edge of a curved flexible panel 57. The upper surface of beam 56 is provided with a groove which is also inclined somewhat and which receives the lower longitudinal edge of panel 57. The grooves are oriented at angles such that panel 57 is held in a compound curvature in the general shape of an "S".

A beam 58 is mounted to extend horizontally along wall 11 at its junction with the floor 59 of the room. A curved flexible panel 60 has its upper longitudinal edge received in a groove formed in the underside of beam 56 and its lower longitudinal edge received in a groove formed in the top surface of beam 58. The grooves are angled such that panel 60 is retained in the compound curvature illustrated in FIG. 6.

A box type wall beam 62 has an outer beam member 63 having a groove in its underside which receives the upper longitudinal edge of a curved flexible panel 64. The lower longitudinal edge of panel 64 is received in a grooved beam 65 mounted to extend along walls 11 and floor 59. Panel 64 is held in a compound shape due to the orientation of the grooves in beams 62 and 65. The box type wall beam 62 provides an elevated shelf on which various items may be placed for display or other purposes.

In the embodiment shown in FIG. 6, curved panels of various shapes cover substantially the entire wall surfaces and the ceiling of the room. Consequently, the room has a pleasant appearance and is sound structurally due to the strength of the beams and the curved panels. The grooves (not shown) in beams 54, 56, 58, and 65 are formed similarly to grooves 39 although their orientation varies, and the curved wall panels fit closely in the grooves in the same manner as shown in FIGS. 3 and 4. Each panel 55, 57, 60, and 64 is a flexible panel like the panels 38 described previously.

Figure 7:
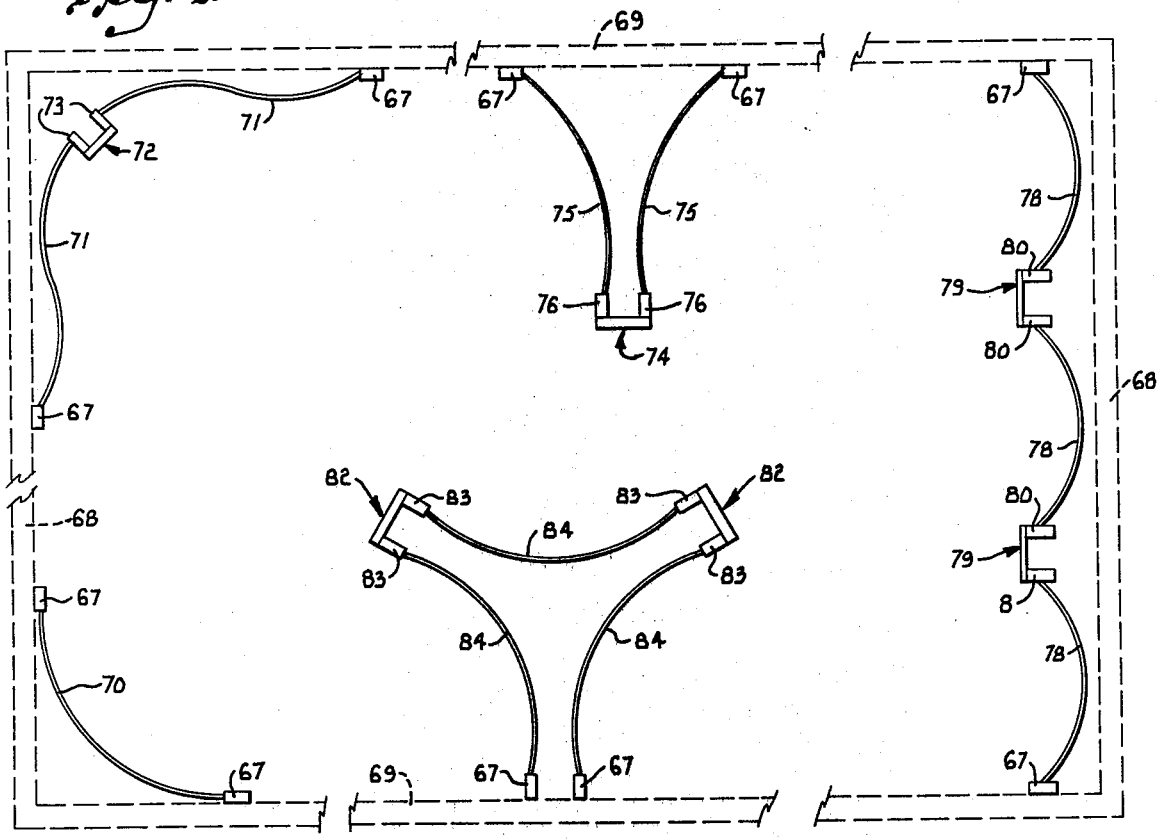
FIG. 7 is a top plan view illustrating still another form of the invention which includes curved partitions and wall panels, with the broken away portions indicating continuous length.

Referring now to FIG. 7, an alternative form of the invention comprises curved walls and partitions which are supported and held in curved shape by upright beams or posts. A plurality of wooden wall beams 67 are secured to extend along the end walls 68 and side walls 69 of a room at selected locations. Beams 67 serve as posts which support and retain curved wall panels such as the flexible corner panel indicated by numeral 70. The vertical edges of panel 70 are received in grooves (not shown) which are formed in beams 67 in an orientation to support the panel in the curved shape shown in FIG. 7. The tendency of the flexible panel to straighten out firmly maintains its edges in the wall beams 67.

Additional wall panels 71 are held in a compound curvature generally in the shape of an "S". One vertical edge of each panel 71 is received in a groove formed in one of the upright wall beams 67, and the opposite edge of the panel is received in a groove formed in a vertical box type beam 72 located away from the walls near a corner of the room. Beam 72 preferably extends between the floor and ceiling of the room, and its structure is like that of the ceiling beams 16 described previously. Beam 72 includes adjustable beam members 73 which are provided with grooves (not shown) that receive the edges of panel 71.

A pair of additional wall beams 67 cooperate with a vertical box type beam 74 to support curved partition panels 75. Beam 74 is constructed essentially the same as the ceiling beams 16 described previously, although it extends vertically between the floor and ceiling of the room at a location well away from side wall 69. A vertical edge of each panel 75 is received in a groove formed in wall beam 67, while the opposite edge of each panel is received in a groove formed in one of the adjustable beam members 76 which are included in beam 74. The spacing between members 76 may be varied in the manner described previously in connection with beam members 18. Panels 75 are concave outwardly, and they therefore present an attractive partition or room divider.

Curved panels 78 are supported to extend generally along the full length of one of the end walls 68. The two end panels 78 extend in curved fashion between wall beams 67 and vertical box type beams 79 which are spaced apart from one another and located slightly inwardly of wall 68. Each beam 79 is constructed essentially the same as the ceiling beams 16, and each includes a pair of adjustable beam members 80 which are spaced apart from one another. The edges of the two end panels 78 are received in grooves in beams 67 and 79, while the edges of the central panel 78 are received in the beam members 80 of the two beams 79.

An additional pair of box type beams 82, identical with the ceiling beams 16 although vertically extending, are spaced apart from one another in the interior region of the room. Each beam 82 has a pair of vertical beam members 83 which are adjustable as to their distance apart. Beams 82 are spaced apart from one another the same distance as each beam is located away from a pair of closely spaced wall beams 67. These two beams 67 and the two box type beams 82 are thus spaced equidistantly in triangular fashion. A pair of curved partition panels 84 extend from the respective beams 82 to the wall beams 67. A third curved panel 84 extends between the two box type beams 82. Panels 84 are concave outwardly and form an attractive partition structure of generally triangular shape.

All of the beams illustrated in FIG. 7 have grooves which are formed to receive the panel edges in essentially the same manner as illustrated in FIGS. 3 and 4 in connection with beams 16 and panels 38. However, the grooves in the beams shown in FIG. 7 are oriented such that they are able to retain their panels in the various shapes which are illustrated. Beams 72, 76, 79, and 82 are generally box shaped in section, although they are open on the side covered by their panels. Each beam extends between the floor and ceiling of the room, and the panels in each set are arranged edge to edge on top of one another to extend between the floor and ceiling. Each panel shown in FIG. 7 is a flexible panel like the ceiling panels 38 shown in FIGS. 1–4. It should be apparent that the beams can be provided with grooves oriented to retain the panels in shapes other than those illustrated.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

Having thus described the invention, I claim:

1. In a ceiling structure for a room which is bounded by walls, the combination of:

a plurality of ceiling panels curved in the general shape of an arch, each ceiling panel having opposite longitudinal edges;

a plurality of rigid ceiling beams for supporting said ceiling panels, each beam being an elongate structure generally box shaped in section;

a pair of rigid beam members extending along opposite sides of each beam in spaced apart relation;

a plurality of spacer elements extending between each pair of beam members at selected locations along the length of the beam to retain said beam members in spaced apart relation;

means for adjusting each spacer element in a manner to vary the spacing between each pair of beam members;

means for supporting said beams at an elevated position in generally horizontal extension between the walls of the room with the beams spaced apart in substantially parallel relationship to one another; and cooperating means on said beams and panel edges for mounting the ceiling panels in extension between the repsective beams with said panels maintained in the general shape of an arch.

2. A combination as set forth in claim 1, wherein said cooperating means includes a groove formed in each beam at an inclined angle, said grooves being sized to closely receive said panel edges in a manner to support the ceiling panels in arch shaped extension between the beams.

3. A combination as set forth in claim 2, wherein said ceiling panels are flexible and have a substantially flat unflexed shape, the close fit of the panel edges in said grooves providing the sole means for coupling the panels with the grooves.

4. A combination as set forth in claim 2, wherein each of said ceiling panels has an end abutting the end of an adjacent ceiling panel to form a joint therebetween and including:

a strip of trim material for covering said joint, said strip having opposite ends; and a notch formed in each beam adjacently below said groove to receive an end of said strip, thereby supporting said strip from the beams in arch shaped extension along the underside of said joint.

5. A combination as set forth in claim 1, wherein said room includes ceiling joists and said beam supporting means includes a plurality of generally vertical hangers secured to said ceiling joists and to said beams.

6. A combination as set forth in claim 1, wherein each spacer element includes:

a pair of brackets secured to the respective beam members in each pair, said brackets overlapping one another; and relesable means for attaching said brackets to one another in overlapping relationship.

7. A combination as set forth in claim 1, including:

a wall beam secured in extension along one of the walls in generally parallel relationship with said ceiling beams; and a curved panel extending between said wall beam and one of said ceiling beams.

8. A combination as set forth in claim 1, wherein the room has a floor and including:

a wall beam secured in extension along one of the walls at a location above the floor and in generally parallel relationship with said ceiling beams; and a curved panel extending substantially between the floor and said wall beam.

9. A combination as set forth in claim 8, including a curved panel extending between said wall beam and one of said ceiling beams.

10. A partition structure for a room having a floor, said partition structure comprising:

a pair of rigid beams extending generally upwardly from the floor at spaced apart locations, each beam being generally box shaped in section;

a pair of rigid beam members extending along opposite sides of each beam in spaced apart relation;

a plurality of spacer elements extending between each pair of beam members at selected locations along the length of the beam to retain said beam members in spaced apart relation;

means for adjusting each spacer element in a manner to vary the spacing between each pair of beam members;

a flexible panel having opposite vertical edges and a generally flat unflexed shape; and a groove presented in each beam and extending substantially the length thereof, said grooves being sized to closely receive the edges of said panel to mount same in extension between the beams and being oriented to retain said panel in a curved shape, with the tendency of the panel to move to a flat unflexed condition exerting forces that retain said panel edges in said grooves.

11. A partition structure as set forth in claim 10, wherein said grooves are disposed at angles retaining said panel in a compound curvature with the panel being in the general shape of an "S" in section.

12. A partition structure as set forth in claim 10, including:

a third rigid beam assembly extending generally upwardly from the floor and spaced substantially equidistantly from the beams in said pair;

a second flexible panel extending in curved fashion between said third beam assembly and one of the beams in said pair; and a third flexible panel extending in curved fashion between said third beam assembly and the other beam in said pair, each of said panels being curved in a manner to present an outwardly facing concave surface.

13. In a ceiling structure for a room which is bounded by walls, the combination of:

a plurality of ceiling panels curved in the general shape of an arch, each ceiling panel having opposite longitudinal edges;

a plurality of rigid ceiling beams for supporting said ceiling panels, each beam being an elongate structure generally box shaped in section;

a pair of rigid beam members extending along opposite sides of each beam in spaced apart relation, said beam members having lower edges;

a bottom beam section for each beam;

magnetic means for releasably retaining the respective bottom beam sections in extension between the lower edges of said beam members to cover said beam members from the bottom and provide a compartment interiorly of each beam between the beam members thereof;

means for supporting said beams at an elevated position in generally horizontal extension between the walls of the room with the beams spaced apart in substantially parallel relationship to one another; and cooperating means on said beams and panel edges for mounting the ceiling panels in extension between the respective beams with said panels maintained in the general shape of an arch.

14. A combination as set forth in claim 13, including:

a light assembly;

means for mounting said light assembly in said beam compartment; and a translucent portion of said bottom beam section underlying said light assembly.

15. In a ceiling structure for a room which is bounded by walls, the combination of:

a plurality of ceiling panels curved in the general shape of an arch, each ceiling panel having opposite longitudinal edges;

a plurality of hollow, box-like ceiling beams each including a pair of elongate beam members spaced apart from one another on opposite sides of the beam to present a hollow compartment interiorly of the beam between said beam members;

a bottom section for each beam adapted to cover said compartment from the bottom;

means for mounting the respective bottom beam sections between the lower portions of the beam members in each ceiling beam in position to cover said compartments from the bottom;

means for supporting said beams at elevated positions in generally horizontal extension between the walls of the room with the beams spaced apart in substantially parallel relationship to one another;

a light assembly mounted within at least one of said compartments above said bottom beam section and between said beam members; and a translucent portion of said bottom beam section underlying said light assembly.

16. A combination as set forth in claim 15, including means for detaching said bottom beam section from at least one of said beam members to provide access to said compartment.

17. A combination as set forth in claim 15, including:

a releasable latch connecting said bottom beam section to one beam member in each pair; and a hinge connecting said bottom beam section to the other beam member in each pair in a manner permitting the bottom beam section to swing about said hinge after release of said latch.

* * * * *